US006063743A

United States Patent [19]

Seubert et al.

[11] Patent Number: 6,063,743

[45] **Date of Patent: *May 16, 2000**

[54] LUBRICATING GREASE COMPOSITION

[75] Inventors: Edwin Seubert, München; Dieter Sohn, Germering, both of Germany

[73] Assignee: Klüber Lubrication München K.G., Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 07/993,896

[22] Filed: Dec. 18, 1992

Related U.S. Application Data

[63] Continuation of application No. 07/640,395, filed as application No. PCT/EP90/00862, May 30, 1990, abandoned.

[30] Foreign Application Priority Data

Jun. 2, 1989 [DE] Germany ..... 39 18 107

[51] Int. Cl.[7] ..... C10M 105/36; C10M 119/14; C10M 145/00

[52] U.S. Cl. ..... 508/481; 508/552

[58] Field of Search ..... 252/51.5 A, 51.5 R, 252/56 S; 508/481, 552

[56] References Cited

U.S. PATENT DOCUMENTS

| | | | |
|---|---|---|---|
| 3,243,372 | 3/1966 | Dreher et al. | 252/51.5 A |
| 3,299,110 | 1/1967 | Pine | 252/56 S |
| 3,620,695 | 11/1971 | McCoy | 252/315.1 |
| 3,766,071 | 10/1973 | Wulfers | 252/51.5 A |
| 3,879,305 | 4/1975 | Ehrlich | 252/51.5 A |
| 4,065,395 | 12/1977 | Bailey | 252/51.5 A |
| 4,692,255 | 9/1987 | Matzat et al. | 252/51.5 A |
| 5,043,085 | 8/1991 | Kinoshita et al. | 252/49.8 |
| 5,164,122 | 11/1992 | Lange et al. | 508/308 |

*Primary Examiner*—Margaret Medley
*Attorney, Agent, or Firm*—Kubovcik & Kubovcik

[57] ABSTRACT

A lubricating grease compound formed of a basic oil and a lower proportion of a thickening agent which is a polyurea (polycarbamide) compound as well as the usual additives, in which the base oil is an ester of an aromatic di-, tri-, or tetra-carboxylic acid with one or more $C_7$–$C_{18}$-alkanols and the thickening agent is the reaction product of a compound of the general formula $$A(B)n \qquad (I)$$

with an amine of the general formula $H_2N$—R (II), wherein

A=$CH_4$-n,

B=aromatic mono- or di-isocyanate residue, n=1–3, and

R=an alkyl or an alkenyl residue with 8 to 22-C-atoms or an aryl residue with 6 to 10-C-atoms, and in which the mixture of the basic oil and the thickening agent has a consistency with a penetration of 220–385, 0.1 mm.

5 Claims, 4 Drawing Sheets

Fig.3

NOISE DAMPENING PROPERTIES OF LUBRICATING AGENTS IN THE ANTI-FRICTION BEARING
STATISTICAL EVALUATION

TABLE 1

12

| LUBRICATING AGENT | AT | x | s | V(%) | $\bar{x}$(%) | s(%) |
|---|---|---|---|---|---|---|
| EXAMPLE 1 | 300 Hz | 21.1 | 7.5 | 35.4 | 114.3 | 240.9 |
| | 1800 Hz | 9.9 | 1.1 | 10.7 | 105.5 | 156.4 |
| | 10000 Hz | 9.5 | 1.4 | 14.7 | 109.0 | 154.9 |
| | PEAK | 9.4 | 2.9 | 30.7 | 211.5 | 427.1 |
| EXAMPLE 2 | 300 Hz | 22.4 | 4.8 | 21.6 | 101.3 | 92.7 |
| | 1800 Hz | 10.6 | 1.1 | 10.6 | 104.3 | 111.8 |
| | 10000 Hz | 12.3 | 2.2 | 18.1 | 99.3 | 87.5 |
| | PEAK | 10.9 | 4.2 | 38.3 | 250.7 | 947.3 |
| EXAMPLE 3 | 300 Hz | 18.0 | 5.2 | 28.8 | 91.6 | 80.0 |
| | 1800 Hz | 9.7 | 1.3 | 13.8 | 102.7 | 93.5 |
| | 10000 Hz | 10.5 | 1.1 | 10.8 | 103.3 | 44.6 |
| | PEAK | 14.9 | 5.3 | 35.7 | 328.8 | 616.1 |

Fig.4

NOISE DAMPENING PROPERTIES OF LUBRICATING AGENTS IN THE ANTI-FRICTION BEARING
STATISTICAL EVALUATION

TABLE 2

13

| LUBRICATING AGENT | AT | $\bar{x}$ | s | V(%) | $\bar{x}$(%) | s(%) |
|---|---|---|---|---|---|---|
| COMPARISON GREASE | 300 Hz | 26.6 | 6.9 | 25.8 | 99.9 | 111.6 |
| | 1800 Hz | 15.9 | 7.2 | 45.4 | 154.7 | 657.6 |
| | 10000 Hz | 21.2 | 9.7 | 45.8 | 153.1 | 653.3 |
| | PEAK | 16.1 | 6.0 | 37.1 | 367.9 | 1132.1 |

LUBRICATING GREASE COMPOSITION

This application is a continuation application Ser. No. 07/640,395 filed Mar. 12, 1991 now abandoned which is a 371 of PCT/EP90/00862 filed May 30, 1990.

DESCRIPTION

The invention concerns a lubricating grease compound formed of a basic oil and a lower proportion of a thickening agent which is a polyurea (polycarbamide) compound and the usual additives.

Such lubricating agents are known for example from the DE-OS 33 03 442, in which the basic oil is a mineral or synthetic oil, such as a naphthene based or paraffin based basic oil and the thickening agent is the reaction product of an isocyanate with at least 3 isocyanate groups in the molecule with a long chain aliphatic monoamine, preferably with 16 to 24 C-atoms.

Such lubricating grease compounds can be used for long duration operational temperatures from 150°–160° C.

Similar compounds, which however contain an ester as a basic oil and have a consistency with a penetration of 220 to 385 at 0.1 mm and in which the thickening agent is made up of an aromatic mono- or di-isocyanate and an alkyl-, alkenyl residue with 8 to 22 C-atoms or an aryl residue with 6 to 10 C-atoms, have been found to have particular noise dampening properties, whereby this property is of significance, in particular with mechanically moving parts in electrical equipment, such as record players, cassette and video cassette recorders etc. Such lubricating grease preparations are especially suited to antifriction bearings, which support temperatures of up to 180° C.

The lubricating grease compound may be formed of 78.95 to 83.95 percent by weight of a basic oil and 15 to 20 percent by weight of a thickening agent which is a polyurea (polycarbamide) compound and the usual additives, characterised in that the base oil is an ester of an aromatic di-, tri-, or tetra-carboxylic acid with one or more $C_7$–$C_{18}$-alkanols and the thickening agent is the reaction product of a compound of the general formula $$A(B)n \qquad (I)$$

with an amine of the general formula $H_2N$-R, in which

A=$CH_4$-n,

B=aromatic mono- or di-isocyanate residue, n=1–3,

R=Alkyl or alkenyl residue with 8 to 22-C-atoms or aryl residue with 6 to 10-C-atoms;

and in which the mixture of the basic oil and the thickening agent has a consistency with a penetration of 220–385, 0.1 mm.

Such lubricating greases comply with NLGI-Category 3 to 0 in accordance with DIN ISO 2137. The preferred basic oils have a viscosity of 18 to 400 $mm^2/s$ at 40° C.

The lubricating agents which are preferred are those in which the basic oil is a $C_8$ to $C_{13}$-alcohol ester of phthalic acid, trimelletic acid or pyromellitic acid and the thickening agent is the reaction/conversion product of a methylene-bis-phenylisocyanate or tolylene di-isocyanate, such as a mixture of 2,4- and 2,6-tolylene diisocyanate with a $C_6$ to $C_{22}$-alkylamine or amines or naphthylamine.

The additives used to combat corrosion, oxidation and protect against metal influences acting as chelates, radical traps, UV-converters and the like, are known in the art and are co mmercially available.

The noise test was carried out by means of an especially appropriate method of experimental procedure, in which an appropriate anti-friction bearing is left to run at revolutions of 1,800 $min^{-1}$.

The noise is measured by means of an acceleration recorder directly on the outer ring of the anti-friction bearing. The oscillations recorded by the apparatus are divided amongst 3 frequency ranges (low 50–300 Hz, medium 300–1,800 Hz, high 1,800–10,000 Hz). In addition maximum peaks are registered.

The measured values are evaluated by a computer and refer to the values which were measured with a reference lubricating agent.

Relative values are therefore obtained, in comparison to the reference value which is fixed at 100%. The lubricating agent prepared in accordance with the invention shows in all areas values of around 100% in comparison to a lubricating agent made from mineral oil and polyurea (polycarbamide) compound, which has a peak value of up to 368%.

The invention is explained in the following examples:

EXAMPLE 1

(A=$CH_3$, n=1, B=aromatic diisocyanate, R=aryl residue with 6-Catoms)

97 g of a mixture made from 2,4- and 2,6 tolylene diisocyanate with 103 g aniline was reacted in 789.5 g of an ester oil, consisting of an ester of phthalic acid and an isomer $C_{13}$-alcohol. After the exothermic reaction had been completed, the admixture was then heated to 160° C. During the cooling period 5 g of a co mmercially available antioxidant, 5 g of a co mmercially available anti-corrosive agent and 0.5 g of a co mmercially available metal deactivator are added.

The greasy admixture was then homogenised by repeatedly milling it in a three-roll mill. This homogenisation process is particularly important for noise dampening properties. In this way an NLGI-Klasse 0 grease is produced in accordance with DIN ISO 2137.

The grease as produced was tested on a noise test bench, which differentiates in accordance with three frequency ranges as well as in accordance with maximum peaks.

A significant reduction in noise levels was measured in comparison to a commercially available lubricating grease made from mineral oil and a long chain branched polyurea (polycarbamide) compound.

EXAMPLE 2

(A=$CH_2$, n=2, B=aromatic monoisocyanate, R=n-Octyl)

74.5 g of diphenyl methane diisocyanate with 75.5 g octyl amine was reacted in the same way as in Example 1, in 839.5 g of an ester oil, consisting of an ester of trimellitic acid and an alcohol mixture made up of $C_8$ and $C_{10}$-alcohols, in the given additives and homogenised.

In this way an NLGI-Klasse 1 grease was produced in accordance with DIN ISO 2137.

The grease produced is tested as in Example 1 and a significant reduction in noise levels was found in comparison to the co mmercially available lubricating grease.

EXAMPLE 3

Diisocyanate and amine as in Example 2 were reacted in 839.5 g of an ester oil, consisting of an ester of pyromellitic acid and an C-8-alcohol isomer. The reaction, the additive provision and homogenisation take place in the same way as in Example 1.

An NLGI-Klasse 1 grease was produced in this way in accordance with DIN ISO 2137.

The grease produced was tested as in Example 1 and a significant reduction in noise levels was found in comparison with the co mmercially available lubricating grease.

Numerical evaluation follows in the enclosed drawings and tables.

Wherein

FIG. 3 shows numerical statistical evaluation of the lubricating agent noise test in accordance with FIG. 1 for Examples 1 to 3;

FIG. 4 shows the same evaluation for the comparison grease in accordance whit FIG. 2.

Figure 1:
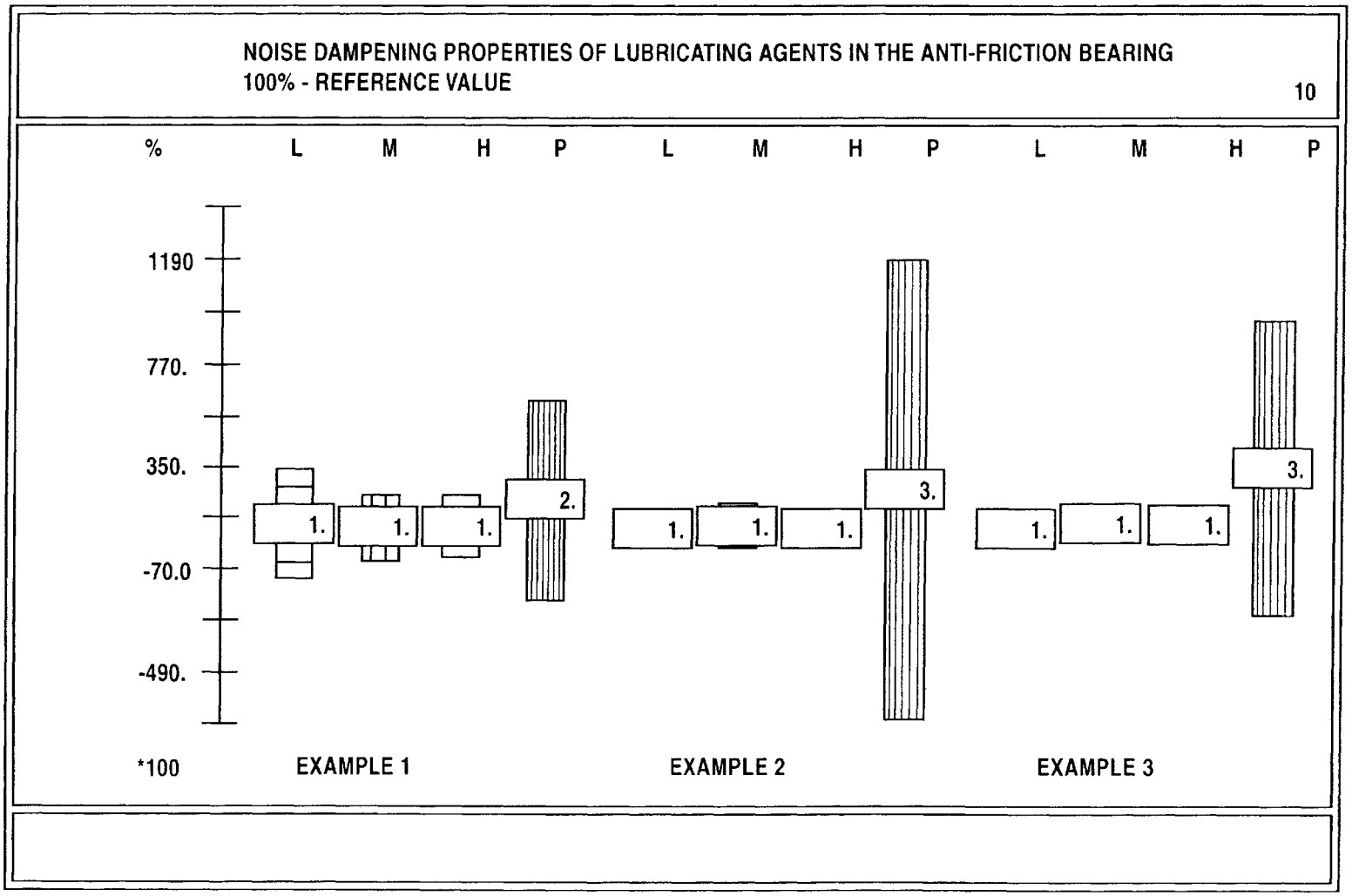
FIG. 1 shows graphic representation of the noise dampening properties of the lubricating agents of Examples 1 to 3 in each of the 3 frequency ranges (1) with maximum peak values (2) or (3).
Figure 2:
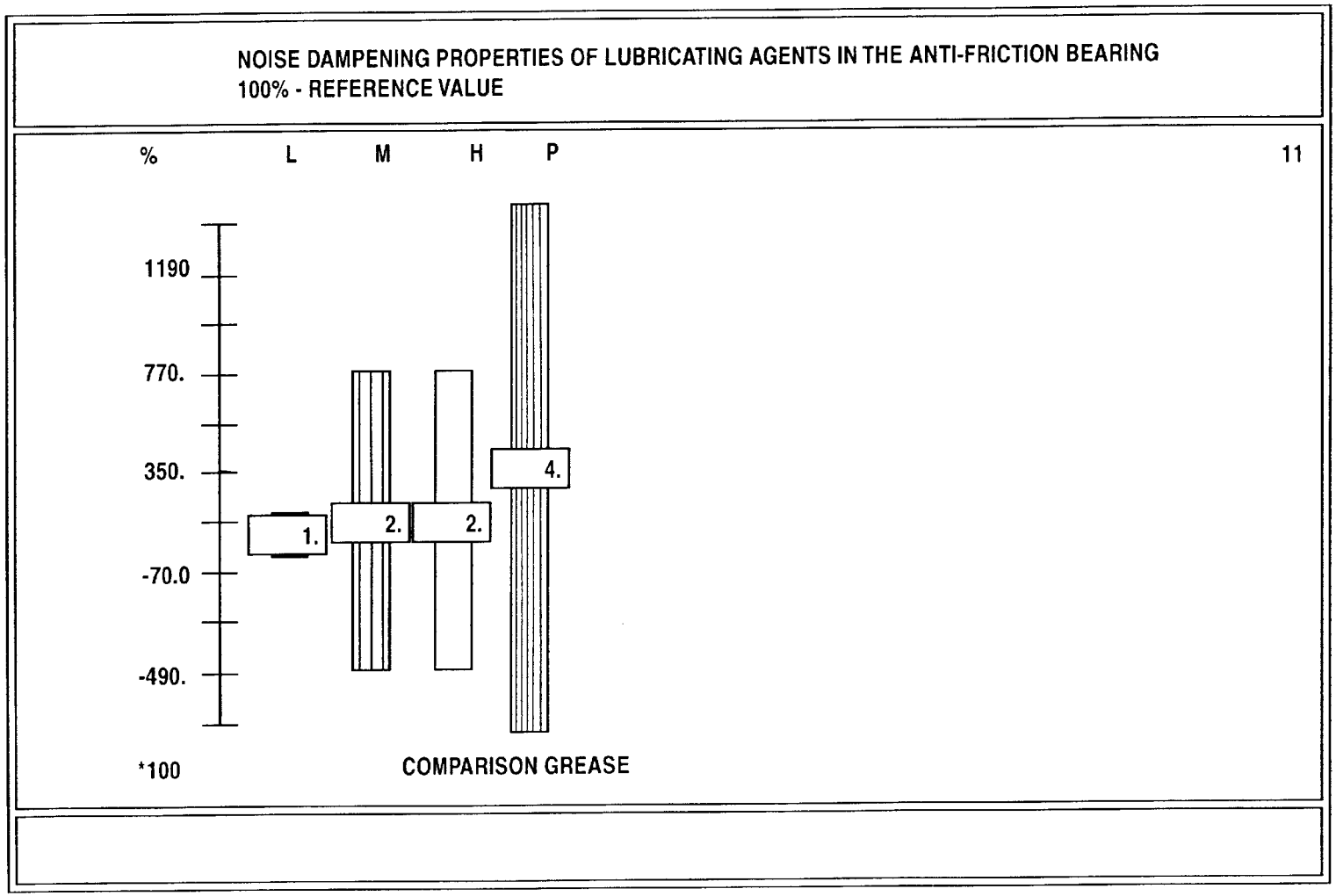
FIG. 2 shows a graphic representation of the noise dampening properties of a comparison state of the art lubricating agent in three frequency ranges (1), (2), as well as the maximum peak value (4).

We claim:

1. A lubricating grease composition comprising 78.95 to 83.95 percent by weight of a base oil consisting of an ester of an aromatic trimellitic acid or pyromellitic acid with one or more $C_8$–$C_{18}$-alkanols and 15 to 20 percent by weight of a polyurea thickening agent consisting of the reaction product of a compound of the formula $$A(B)n \quad (I)$$

with an amine of the formula $H_2N$—R (II), in which

A=$CH_{4-n}$

B=aromatic mono isocyanate residue, n=2,

R=alkyl or alkenyl aliphatic residue with 8 to 22-C-atoms; and in which the mixture of the basic oil and the thickening agent has a consistency with a penetration of 220–385, 0.1 mm.

2. A lubricating grease compound in accordance with claim 1, wherein B in Formula I is a 2,4 and/or 2,6 tolylene diisocyanate residue.

3. A lubricating grease compound in accordance with claim 1, further including about 0.5 percent by weight of an antioxidant.

4. A lubricating grease compound in accordance with claim 1, further including about 0.5 percent by weight of an anti-corrosive agent.

5. A lubricating component in accordance with claim 1, further including about 0.05 percent by weight of a metal deactivator.

* * * * *